United States Patent [19]

Kobayashi

[11] Patent Number: 4,871,174

[45] Date of Patent: Oct. 3, 1989

[54] GOLF CLUB

[75] Inventor: Masashi Kobayashi, Matsudo, Japan

[73] Assignee: Maruman Golf Co., Ltd., Tokyo, Japan

[21] Appl. No.: 314,261

[22] Filed: Feb. 24, 1989

Related U.S. Application Data

[63] Continuation of Ser. No. 44,532, May 1, 1987, abandoned.

[30] Foreign Application Priority Data

May 31, 1986 [JP] Japan ..... 61-124636

[51] Int. Cl.[4] ..... A63B 53/04

[52] U.S. Cl. ..... 273/164; 273/169; 273/80 C; 273/80 A; 273/167 C; 273/167 H

[58] Field of Search ..... 273/164, 169, 171, 80 C, 273/80 A, 167 C, 80 R, 80.1, 80.2, 167 R, 167 A, 167 B, 167 D, 167 F, 167 G, 167 H

[56] References Cited

U.S. PATENT DOCUMENTS

| | | | |
|---|---|---|---|
| 2,155,830 | 4/1939 | Howard | 273/80 C |
| 3,516,674 | 6/1970 | Scarborough | 273/171 X |
| 3,675,923 | 7/1972 | Allen et al. | 273/80 C |
| 3,966,210 | 6/1976 | Rozmus | 273/80 C |
| 4,010,958 | 3/1977 | Long | 273/164 |
| 4,174,110 | 11/1979 | Yamamoto | 273/169 |
| 4,390,184 | 6/1983 | Rudell | 273/164 |

FOREIGN PATENT DOCUMENTS

| | | | |
|---|---|---|---|
| 59-12916 | 4/1984 | Japan | 273/164 |

OTHER PUBLICATIONS

"Golf Digest", Jul. 1972, p. 83.

*Primary Examiner*—George J. Marlo
*Attorney, Agent, or Firm*—Armstrong, Nikadio, Marmelstein, Kubovcik & Murray

[57] ABSTRACT

In a golf club for putting, the head of the club comprises a face plate having a hitting surface extending between opposite toe and heel sides of the head and a back surface extending substantially in parallel to the hitting surface. A pair of spaced rod-like bodies are fixed to the back surface of the face plate at the toe and heel sides of the head, respectively, and extend backward and in a direction perpendicular to the hitting surface of the face plate. A shaft-mounting body, for mounting the shaft thereon, is fixedly disposed between the rod-like bodies. A hosel member is attached to the top surface of said shaft-mounting body substantially at a center of the head, the hosel member extends upwardly from the shaft-mounting body to a position near a plane containing the face plate and is connected to the shaft at that position.

6 Claims, 2 Drawing Sheets

GOLF CLUB

This application is a continuation of application Ser. No. 044,532 filed May 1, 1987, now abandoned.

BACKGROUND OF THE INVENTION

1. Field of the Invention

The present invention relates to a golf club, more particularly, to an improvement of a putter club (hereinafter, putter).

2. Description of the Related Arts

Japanese Examined Utility Model Publication No. 59-12916 discloses a putter having a head which comprises a rod-like body having a longitudinal axis. The rod-like body is provided at one end thereof with a thin face plate, for defining thereon a hitting surface for hitting a golf ball, extending in a direction perpendicular to the longitudinal axis of the rod-like body. The rod-like body is provided at the upper portion thereof with a shaft fixed thereto.

In the above-mentioned conventional putter, the distribution of weight of the head is concentrated substantially at the center axis of the hitting surface, and thus the hitting surface of the head has only a small sweet spot area. Accordingly, the above-mentioned conventional putter has a disadvantage in that when the golf ball is hit, the point of impact between the head and the ball is apt to be outside the sweet spot area of the head. This is particularly disadvantageous for a long put, since the distance run by the ball when hit by the head outside the sweet spot area becomes extremely short and the direction of run of the ball deviates greatly from a target line. Further, the head is apt to rotate about a center axis of the portion connecting the shaft to the rod-like body during a swing of the golf club, and thus it is difficult to keep the hitting surface of the head orientated on a target.

SUMMARY OF THE INVENTION

Therefore, according to the present invention, there is provided a golf club having a head and a shaft, the head comprising: a face plate having a hitting surface extending between opposite toe and heel sides of the head and a back surface extending substantially in parallel to the hitting surface; a pair of spaced rod-like bodies fixed to the back surface of the face plate at the toe and heel sides of the head, respectively, and extending backward and in a direction perpendicular to the hitting surface of the face plate; and a shaft-mounting body, for mounting the shaft thereon, fixedly disposed between the rod-like bodies.

In the golf club according to the present invention, the rod bodies fixed to the face plate are disposed at the toe and heel sides of the head, so that the weight of the head is distributed to the toe and heel sides of the head, and thus a sweet spot area of the hitting surface of the face plate is extended toward the toe and heel sides of the head. Therefore, when a golf ball is hit by the head at a position deviated from the center of the sweet spot area, the distance run by the ball is not greatly decreased and the direction of run of the ball does not greatly deviate from a target line. Further, since a moment of inertia of the head about the center of gravity of the head is increased due to the provision of the rod-like bodies at the toe and heel sides of the head, it is easy to prevent a rotation of the head about a center axis of a portion connecting the shaft-mounting body to the shaft to keep the hitting surface of the face plate orientated on a target during a swing of the golf club.

BRIEF EXPLANATION OF THE DRAWINGS

The foregoing and other features and advantages of the present invention will be better understood from the following description with reference to the preferred embodiments illustrated in the drawings; wherein.

DESCRIPTION OF THE PREFERRED EMBODIMENTS

Figure 1:
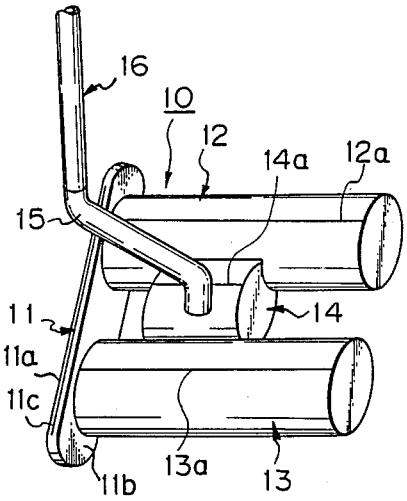
FIG. 1 is a perspective view of a head and a part of a shaft of a putter illustrating a first embodiment of the present invention.
Figure 2:
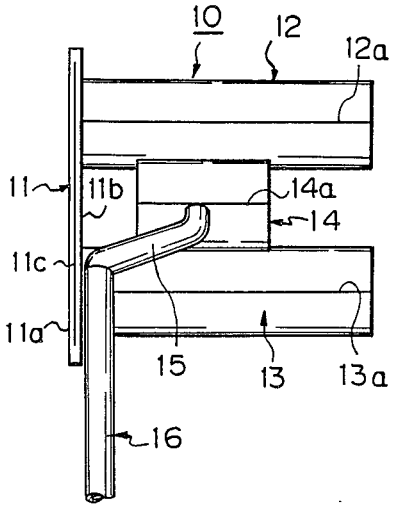
FIG. 2 is a plan view of the head and the part of the shaft shown in FIG. 1.

FIGS. 1 and 2 illustrate a first embodiment of the present invention. Referring to these Figures, a golf club, i.e., a putter, comprises a head 10 and a shaft 16 having at the tip end thereof a rod-like hosel portion 15 fixed thereto. In this embodiment, the hosel portion 15 has substantially a crank-like shape. The head 10 comprises a thin face plate 11 having a hitting surface 11*a* extending between toe and heel sides of the head 10 and a back surface 11*b* extending substantially in parallel to the hitting surface 11*a*. A pair of spaced rod-like bodies 12 and 13, each having a substantially cylindrical outer surface, are fixed to the back surface 11*b* of the face plate 11 at the toe and heel sides of the head 10 and extend backward and in a direction perpendicular to the hitting surface 11*a* of the face plate 11. A rod-like shaft-mounting body 14 having a length shorter than those of the rod-like bodies 12 and 13 is fixedly disposed between the rod-like bodies 12 and 13. The shaft-mounting body 14 is fixed at the top surface thereof to the hosel portion 15 of the shaft 16.

The face plate 11 is formed at the top surface thereof with a pilot line 11*c* extending between the toe and heel sides of the head 10 in parallel to the hitting surface 11*a*, and the rod-like bodies 12 and 13 are formed at the top surfaces thereof with other pilot lines 12*a* and 13*a*, respectively, extending in a direction perpendicular to the hitting surface 11*a* of the face plate 11. Further, in this embodiment, the shaft-mounting body 14 is formed at the top surface thereof with another pilot line 14*a* extending in a direction perpendicular to the hitting surface 11*a* of the face plate 11. The pilot line 14*a* is formed so that the center of the hitting surface 11*a* of the face plate 11, i.e., the center of a sweet spot area, is located on the extension of the pilot line 14*a*.

In this embodiment, the shaft-mounting body 14 is fixedly connected to the rod-like bodies 12 and 13, and spaced from the back surface 11*b* of the face plate 11 to form a clearance therebetween. Preferably, the rod-like bodies 12 and 13 and the shaft-mounting body 14 are produced as one body by monoblock molding, to reduce the number of steps of the manufacturing process. The rod-like bodies 12 and 13 may be fixed to the face plate 11 by welding or screws (not shown). The rod-like bodies 12 and 13 and the shaft-mounting body 14 may be made of metal, such as Al (aluminum), Bs (brass) or Fe (ferrite), or plastic, or ceramic, and the face 11 may be made of the same material as those of the rod-like bodies 12 and 13 and the shaft-mounting body 14, or of transparent plastic.

In the putter having the above-mentioned construction, the rod-like bodies 12 and 13 fixed to the face plate 11 are disposed at the toe and heel sides of the head 10, so the weight of the head is distributed to the toe and heel sides of the head 10, and thus the sweet spot area of the hitting surface 11*a* of the face plate 11 is extended toward the toe and heel sides of the head 10. Therefore, when a golf ball is hit by the head 10 at a position deviated from the center of the sweet spot area of the head 10, a distance run by the ball is not greatly decreased and a direction of run of the ball does not greatly deviate from a target line. Further, since the moment of inertia of the head 10 about the center of gravity of the head 10 is increased due to the provision of the rod-like bodies 12 and 13 at the toe and heel sides of the head 10, it is easy to prevent rotation of the head 10 about a center axis of a connecting portion of the shaft-mounting body 14 with the hosel portion 15 of the shaft 16, to keep the hitting surface 11*a* of the face plate 11 orientated on a target during a swing of the golf club.

Furthermore, since the rod-like bodies 12 and 13 extending in a direction perpendicular to the hitting surface 11*a* of the face plate 11 are disposed at the toe and heel sides of the head 10, it is easy, when addressing the ball, to accurately orientate the hitting surface 11*a* of the face plate 11 on the target. In particular, the pilot lines 12*a* and 13*a* on the rod-like bodies 12 and 13 can serve, when addressing the ball, to provide a much better orientation of the hitting surface 11*a*.

Figure 3:
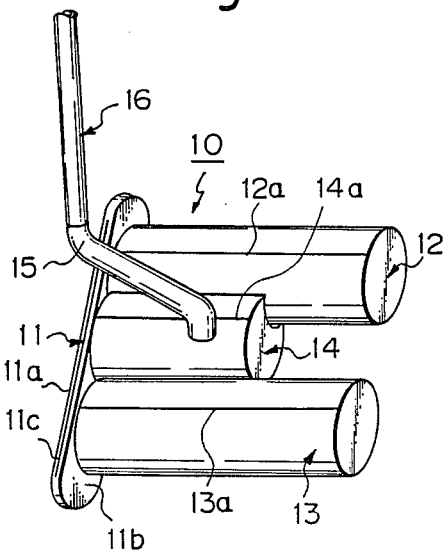
FIG. 3 is a perspective view of a head and a part of a shaft of a putter illustrating a second embodiment of the present invention.
Figure 4:
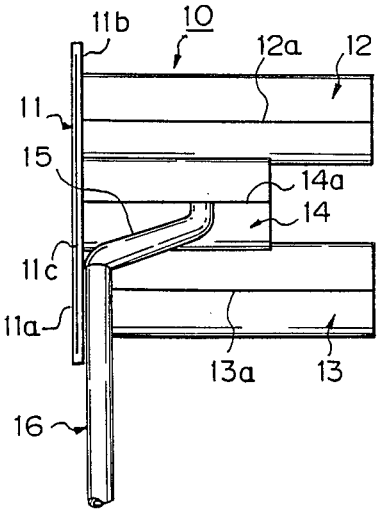
FIG. 4 is a plan view of the head and the part of the shaft shown in FIG. 3.

FIGS. 3 and 4 illustrate a second embodiment of the present invention. In these Figures, constituent elements of the putter corresponding or similar to those of the first embodiment are denoted by the same reference numerals as those used in FIGS. 1 and 2, respectively.

Referring to FIGS. 3 and 4, the shaft-mounting body 14 fixed to the pair of rod-like bodies 12 and 13 is also fixed to the back surface 11*b* of the face plate, and has a length shorter than those of, the rod-like bodies 12 and 13, but greater than that of the shaft-mounting body 14 in the first embodiment. The rest of the construction of the putter in the second embodiment is the same as that of the first embodiment, and the constituent elements in the second embodiment can be made of the same materials as those of the corresponding constituent elements in the first embodiment, respectively, and in the same manner as that of the first embodiment described above.

The construction of the putter according to the second embodiment has an advantage in that a distance run by a ball hit by the head 10 at the central portion of the hitting surface 11*a* of the face plate 11 is further increased, compared to that obtained by the putter of the first embodiment, due to the provision of the shaft-mounting body 13 fixed to the face plate 11.

Figure 5:
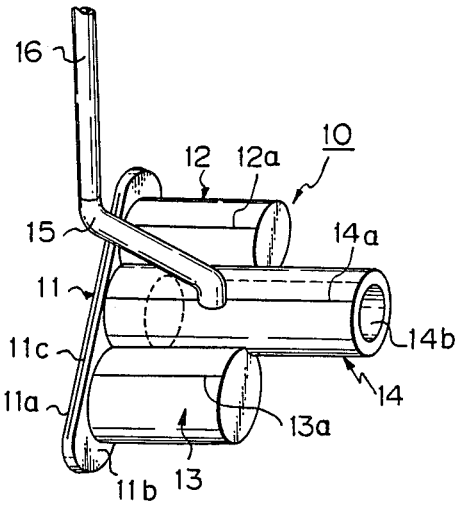
FIG. 5 is a perspective view of a head and a part of a shaft of a putter illustrating a third embodiment of the present invention.
Figure 6:
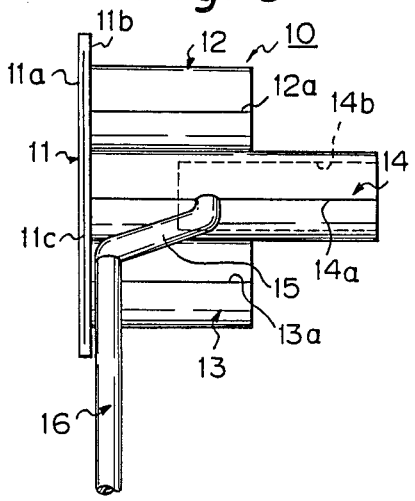
FIG. 6 is a plan view of the head and the part of the shaft shown in FIG. 5.

FIGS. 5 and 6 illustrate a third embodiment of the present invention. In these Figures, constituent elements of the putter correponding or similar to those of the first embodiment are denoted by the same reference numerals as those used in FIGS. 1 and 2, respectively.

Referring to FIGS. 5 and 6, the shaft-mounting body 14 fixed to the pair of rod-like bodies 12 and 13 is also fixed to the back surface 11*b* of the face plate 11, as in the second embodiment, but has a length greater than those of the rod-like bodies 12 and 13. The shaft-mounting body 14 in the third embodiment has therein a cylindrical cavity 14*b* extending in the longitudinal direction thereof to decrease the weight of the shaft-mounting body 14 and distribute the weight of the head 10 to the toe and heel sides of the head 10. The rest of the construction of the putter in the third embodiment is the same as that of the first and second embodiments, and the constituent elements in the third embodiment can be made of the same materials as those of the corresponding constituent elements in the first and second embodiments, respectively, and in the same manner as that of the first embodiment described above.

The shaft-mounting body 14 may be made of a material having a specific gravity less than those of the rod-like bodies 12 and 13, instead of forming a cavity therein.

Figure 7:
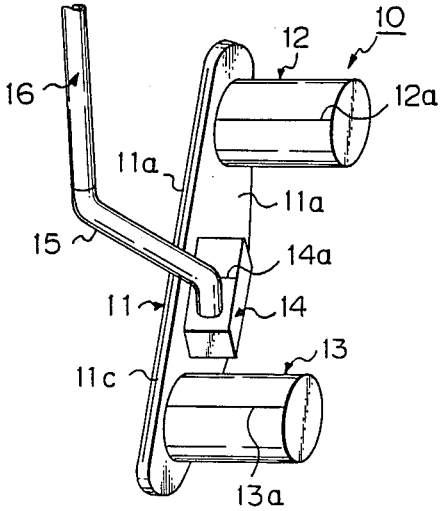
FIG. 7 is a perspective view of a head and a part of a shaft of a putter illustrating fourth embodiment of the present invention.
Figure 8:
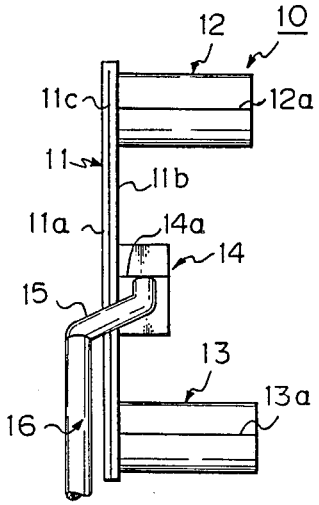
FIG. 8 is a plan view of the head and the part of the shaft shown in FIG. 7.

FIGS. 7 and 8 illustrate a fourth embodiment of the present invention. In these Figures, constituent elements of the putter corresponding or similar to those of the first embodiment are denoted by the same reference numerals as those used in FIGS. 1 and 2, respectively.

Referring to FIGS. 7 and 8, the shaft-mounting body 14 disposed between the pair of rod-like bodies 12 and 13 is separated from the rod-like bodies 12 and 13 and fixed to the back surface 11*b* of the face plate 11. The rest of the construction of the putter in the fourth embodiment is the same as that of the first and second embodiments, and the constituent elements in the fourth embodiments can be made of the same materials as those of the corresponding constituent elements in the first, second, and third embodiments, respectively, and in the same manner as that of the first embodiment described above.

In the fourth embodiment, since the shaft-mounting body 14 is separated from the rod-like bodies 12 and 13, the weight of the head 10 can be efficiently distributed to the toe and heel sides of the head 10 by reducing the size of the shaft-mounting body 14, and it is easy to increase the length of the face plate 11 between the toe and heel sides of the head 10 to dispose the rod-like bodies 12 and 13 at positions away from the center of the hitting surface 11*a* of the face plate 11. Accordingly, a moment of inertia of the head 10 about the center of gravity thereof can be increased compared to those of the preceding embodiments.

While particular embodiments shown in the Figures and the disclosure of the present invention have been described, it will be understood that the present invention is not limited thereto, since modification can be made by those skilled in the art in the light of the foregoing teachings. For example, each of the rod-like bodies may have a cross-section other than a circular cross-section. The hosel portion of the shaft may be formed in any shape, and the shaft may be directly connected to the shaft-mounting body.

I claim:

1. A golf club having a head and a shaft, said head comprising:

a thin face plate having a generally flat hitting surface extending between toe and heel sides of said head and a generally flat back surface extending substantially in parallel to said hitting surface;

a pair of cylindrical bodies each having one end thereof fixed to said back surface of said face plate such that one of said pairs is fixed at a position adjacent to said toe side and the other is fixed at a position adjacent to said heel side of said face plate, said pair of cylindrical bodies extending backward in a direction perpendicular to said hitting surface of said face plate with a clearance between said pair of cylindrical bodies;

a shaft-mounting body disposed between said pair of cylindrical bodies and fixed to at least one of said face plate and said pair of said cylindrical bodies such that a center of gravity of said head is in said shaft-mounting body; and a hosel member attached to said shaft-mounting body, said hosel member including a first portion extending upwardly from said shaft-mounting body, a second portion extending further upwardly from said first portion at a first angle with respect to said shaft-mounting body to a position near a plane containing said face plate and third portion being bent from said second portion at a second angle greater than said first angle, said second portion being connected to said shaft in a manner such that the axis of said shaft passes in front of said center of gravity of said head.

2. A golf club according to claim 1, wherein said shaft-mounting body is fixed solely to said pair of cylindrical bodies and spaced form said back surface of said face plate leaving a clearance therebetween.

3. A golf club according to claim 1, wherein said shaft-mounting body is fixed to said pair of cylindrical bodies and said back surface of said face plate.

4. A golf club according to claim 3, wherein said shaft-mounting body extends in parallel to said pair of cylindrical bodies and has a length greater than those of said pair of cylindrical bodies.

5. A golf club according to claim 1, wherein said shaft-mounting body is fixed to said back surface of said face plate and spaced from said pair of cylindrical bodies.

6. A golf club according to any one of preceding claims 1 to 5, wherein said shaft-mounting body extends in parallel to said pair of cylindrical bodies and has a length less than those of said pair of cylindrical bodies.

* * * * *